United States Patent [19]

Wazenegger

[11] Patent Number: 4,489,762

[45] Date of Patent: Dec. 25, 1984

[54] WEAVING LOOM SELVEDGE TRIMMER DRIVE MECHANISM

[75] Inventor: Donald R. Wazenegger, Kernersville, N.C.

[73] Assignee: Draper Corporation, Greensboro, N.C.

[21] Appl. No.: 483,547

[22] Filed: Apr. 11, 1983

[51] Int. Cl.[3] ..... D03D 49/70

[52] U.S. Cl. ..... 139/303

[58] Field of Search ..... 139/302, 303, 429, 450, 139/431

[56] References Cited

U.S. PATENT DOCUMENTS 2,868,235 1/1959 Cederlund et al. ..... 139/303
4,134,434 1/1979 Malasek et al. ..... 139/302
4,252,155 2/1981 Murasaik ..... 139/431

FOREIGN PATENT DOCUMENTS 1410749 10/1968 Fed. Rep. of Germany ..... 139/302

*Primary Examiner*—Henry S. Jaudon
*Attorney, Agent, or Firm*—Charles R. Rhodes; Judith E. Garmon

[57] ABSTRACT

The selvedge trimmer of a weaving loom utilizing a short sword system is operated responsive to the arcuate reciprocal motion of the rocker shaft. A "four bar linkage" system operatively connects the rocker shaft with the cutter apparatus in such a manner that the arcuate movement of the rocker shaft is transmitted to the cutter mechanism after effecting a suitable reduction of the stroke length.

4 Claims, 3 Drawing Figures

WEAVING LOOM SELVEDGE TRIMMER DRIVE MECHANISM

BACKGROUND AND SUMMARY OF THE INVENTION

In the weaving of textile fabrics in the textile industry, it is conventional practice for a filling yarn to be introduced from one side of the loom (hereinafter referred to as the right hand side, even though some looms introduce filling yarn from the left hand side). For this purpose a plurality of packages of yarn are stored at or near the right hand side of the loom, and the rapier or air jet weft insertion system carries the weft yarn across the weaving shed. Conventional filling or weft introducing apparatuses contain a cutting apparatus to cut the yarn on the side from which it is fed and provide a trimmed selvedge on this side. There is also formed on the opposite side of the fabric (hereinafter the left hand side of the loom), a selvedge which must be trimmed away. There are known in the prior art trimming apparatuses for trimming this "left hand selvedge" also. However, generally such left hand selvedge trimmers are operated from cams and utilize gears, springs, auxiliary shafts, and the like which add considerable cost and complexity, and potentially reduce the reliability of the selvedge trimming operation. A representative sample of selvedge trimming apparatuses are disclosed in the following patents:

| U.S. Pat. No. | Inventor | Issue Date |
|---|---|---|
| 2,226,069 | E. Nadeau | 12/24/40 |
| 3,402,744 | V. Scherillo | 9/24/68 |
| 3,613,741 | A. Ravella | 10/19/71 |
| 4,134,434 | J. Malasek | 1/16/79 |
| 4,185,667 | E. Kendrick | 1/29/80 |
| 4,296,783 | E. Ichimatsu | 10/27/81 |

Rather than operating the "left hand" selvedge trimmer from cam shaft or utilizing separate timing devices to activate the selvedge trimmer, it would be advantageous if this selvedge trimmer could be operated by the arcuate reciprocal motion of the lay or sword system for the lay. Attempts to accomplish this have generally met with little success, however, because conventional lay activating systems utilize a relatively large pivot arm (long sword), and the stroke is too long to provide a reliable cutter stroke for the selvedge trimmer. Further, the impact of the lay on the trimmer mechanism is likely to damage the trimmer apparatus or the lay due to the high impact forces imparted.

In accordance with the present invention, however, it has been found that in a "short sword system" (where the rocker shaft is positioned higher in the framework of the loom nearer to the lay than in conventional systems), operation responsive to the lay is possible. The combination of the short sword system and a unique type of linkage between the rocker shaft and the trimmer mechanism are utilized in the present invention to effect a successful "left hand" selvedge trimming operation which is operated responsive to the arcuate reciprocal motion of the rocker shaft. Toward this end, a "four bar linkage" concept is utilized to connect the rocker shaft with the cutter support shaft which supports the movable blade of the selvedge trimmer. This linkage so connects the rocker shaft with the cutter blade, that the relatively large, abrupt movement of the rocker shaft is reduced to a smooth pivotal movement of the shaft which supports the cutter blade. Further, the linkage is so constructed as to avoid any obstructions which naturally occur between the rocker shaft and the trimmer mechanism. The relatively strong reciprocal movements of the lay during the beat up operation are thus converted to smooth trimming strokes of the cutter blade to effect the selvedge trimming responsive thereto.

It is therefore an object of the present invention to operate the "left hand" selvedge cutter directly from the reciprocal motion of the lay in a short sword weaving system, whether the short sword system being utilized is on shuttleless loom or an air jet loom.

It is another object of the present invention to provide a "left hand" selvedge trimming mechanism of the type described in which a "four bar linkage" connects the rocker shaft of the short sword system to the cutter blade support shaft of the trimming mechanism to reduce the abrupt long strokes of the lay sufficiently to operate the selvedge trimmer.

Other objects and a fuller understanding of the invention will become apparent upon reading the following detailed description of a preferred embodiment along with the accompanying drawings in which.

DETAILED DESCRIPTION OF A PREFERRED EMBODIMENT

Figure 1:
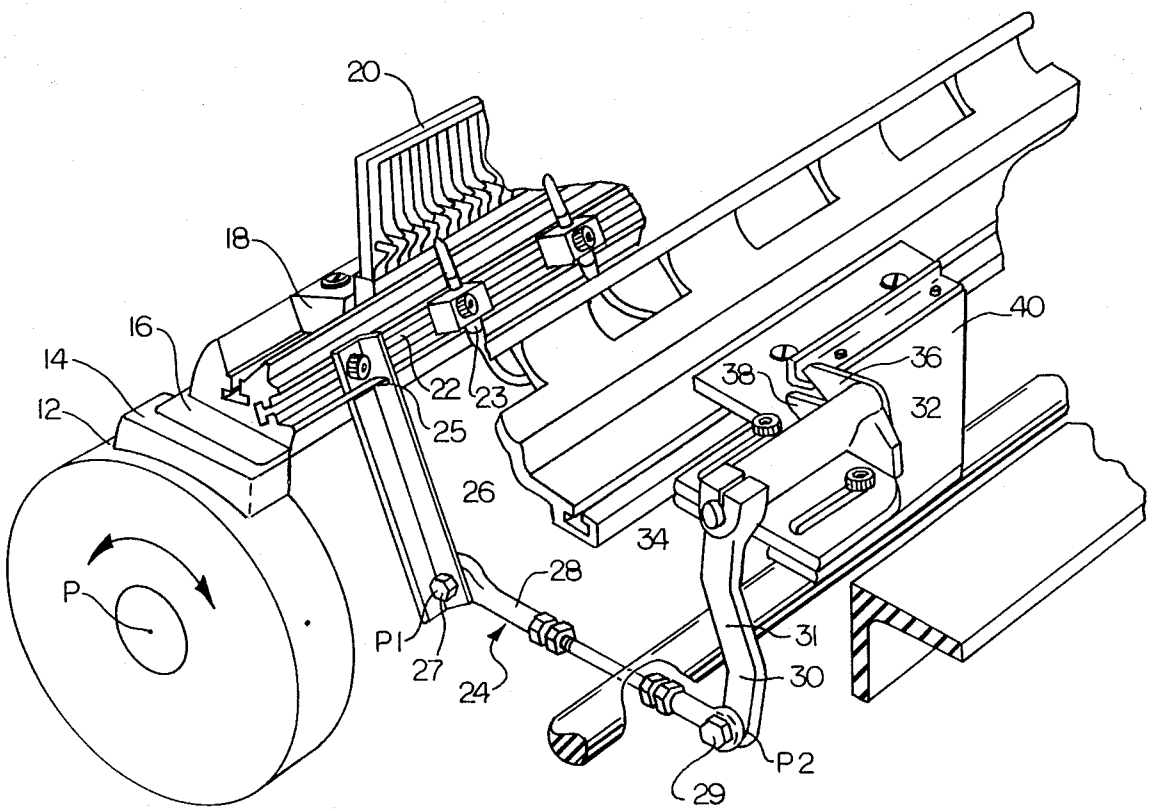
FIG. 1 is a perspective view of the left hand side of a weaving loom, with parts broken away, illustrating the drive system for the left hand selvedge trimmer according to the present invention.

Turning now to the drawings, and particularly to FIG. 1, there is illustrated the pertinent portions of the left hand side of a short sword loom system. The rocker shaft 10 is mounted on the framework of the weaving machine at an appropriate position up very near the lay 16. Rocker shaft 10 is so driven by the loom mechanism as to arcuately reciprocate thereby causig the loom reed 20 to beat up the filler yarn after each pick thereof. The operation of the rocker shaft and its connection to the loom mechanism in a short sword system is all conventional and need not be further explained here.

A mounting bracket 12 (otherwise known as the short sword) extends outwardly from rocker shaft 10 and includes a shelf or ledge 14 upon which the lay 16 is secured. The lay 16 extends completely across the width of the loom and utilizes a clamp 18 to secure the loom reed 20 therein in a conventional manner. For purposes of explanation, the following disclosure will be described in connection with an air jet loom; however, it is readily apparent that the concept of the present invention is equally applicable to other types of shuttleless looms. On the forward side of the lay 16, in some air jet looms there is provided a track 22 in which a plurality of auxiliary air nozzles 23 are mounted. The operation of the auxiliary air nozzles is not important to the present invention, and will not be discussed further herein.

However, according to a preferred embodiment of the present invention, a linkage means 24 is connected at one end thereof to the aforesaid track 22 or at some other convenient location on the lay. The other end of linkage 24 connects to a pivot shaft 34 journaled in a bearing 32 to which the movable cutter blade 36 is attached. Bearing 32 is also mounted to the cutter mechanism support 40 and supports the stationary portion 38 of the cutter blade.

Linkage means 24 includes a first arm or lever 26 attached at one end (the upper end) thereof to the aforesaid track 22. This attachment may be made by means of a threaded stud 25 having the nut thereof inserted in the underside of the track 22 with the threaded portion extending through the slot therein and receiving the first arm or lever 26 through an opening in one end thereof. The opposite or lower end of arm 26 is pivotally attached to a link 28 by means of a pivot pin 27. So arranged the first arm 26 is secured at the upper end thereof to the track, while the lower end is pivotally attached to link 28 establishing a first movable pivot point B. The second or forward end of link 28 is pivotally attached to the lower end of a second lever 30 by means of another pivot pin 29, thus establishing a second movable pivot point C. Link 28 is composed of a spherical rod end bearing at each end, with a threaded rod between them. The spherical rod end bearings allow for some angular misalignment of link 28 between 26 and 30, and the threaded rod allows adjustment of length of link 28; this adjustment is used to ensure that links 28 and 30 do not interfere with cam shaft 42, the angle member 50 or other parts of the trimmer apparatus. The adjustment is not used to adjust cutter stroke. The lever 30 extends upwardly and rearwardly from its point of attachment with link 28 to its attachment with the cutter support shaft 34. The upper end of lever 30 is secured to one end of shaft 34, so that as the lever 30 is caused to move in an arcuate path, the cutter support shaft 34 is caused to rotate. The movable blade 36 is attached to the opposite end of shaft 34, and is thus activated thereby.

The third arm or lever 30 is offset at 31 so that the linkage mechanism 24 avoids the air control cam shaft 42 which in some looms extends beneath the cutter mechanism.

Figure 2:
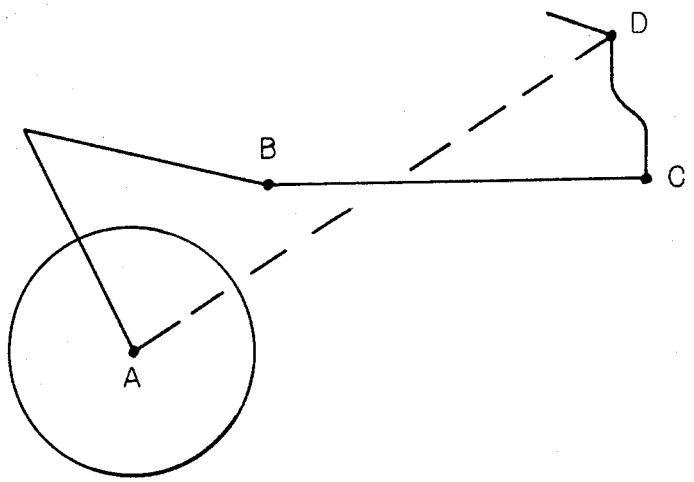
FIG. 2 is a schematic side view of the mechanism illustrating the rocker shaft positioned in its lay withdrawn position where the cutting blade is open.

Turning now to FIG. 2 there is shown schematically the manner in which the linkage mechanism operates effectively as a "four bar linkage." In FIG. 2, consider the pivot point P of the rocker shaft 10 to be point A of the "four bar linkage." Since the rocker shaft, the sword or bracket 12, the lay 16, and the first arm 26 of the linkage mechanism are all secured together and immovable relative to each other, the second point of the "four bar linkage" is the lower end of the first lever arm 26, or point B in FIG. 2. Therefore, the imaginary line AB is a lever of the "four bar linkage" which oscillates in an arcuate path responsive to rotation of the rocker shaft 10 between the position shown in FIG. 2 and the position shown in FIG. 3. Thus, the link 28 becomes the link BC in FIGS. 2 and 3. Finally, the third arm or lever 30 joins points C and D to become the other lever in the "four bar linkage" mechanism which also oscillates in an arcuate path responsive to movement of the first arm or lever AB. Of course, points A and D are fixed so that the imaginary line AD does not move or rotate.

Figure 3:
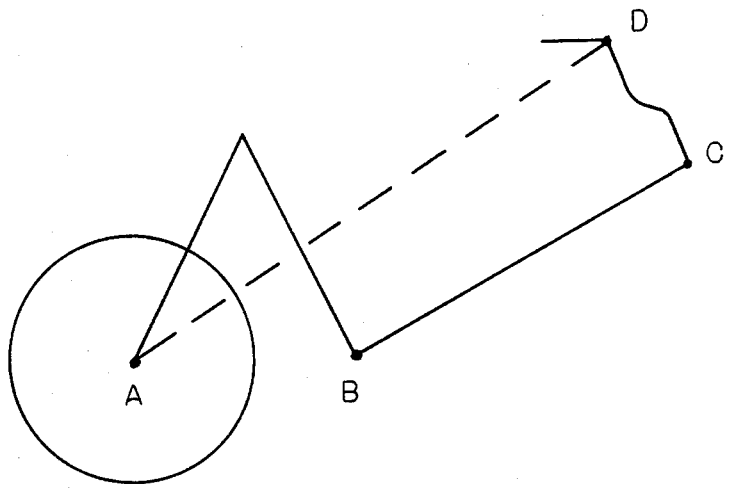
FIG. 3 is a side view, similar to FIG. 2, except showing the rocker shaft moved to the lay "beat-up" position where the cutter blade is closed.

As can be seen in FIGS. 2 and 3, movement of the rocker shaft 10 from the position in which the lay 16 is withdrawn forwardly to the position shown in FIG. 3 where the lay is beating the filling into the fabric, causes movement at point B from the position shown in FIG. 2 to the position shown in FIG. 3. While this movement is rather large and abrupt, the resulting movement of lever CD is not as great, and the movement of the movable cutter blade 36 is very slight relative to the movement of point B, so that a controlled cutting stroke of the cutting mechanism can be effected.

Thus, there is no need for any special cam or timing devices, and the operation of the cutter mechanism is solely and directly responsive to the arcuate reciprocal movement of the lay 16. Therefore, expensive cams, gears, springs, auxiliary shafts and the like which normally add cost and complexity, and potentially lead to reduced reliability, are avoided. Further, because the four bar mechanism is mounted in the track 22, it can be adjusted laterally across the width of the loom mechanism to any desired location.

While the preferred embodiment has been described in detail hereinabove, it should be realized that various changes and modifications might be made without departing from the scope of the invention. For instance, as has been previously recited, while the description is carried out with reference to an air jet loom, the invention may be applicable to other types of shuttleless looms. Therefore, the scope of the invention is to be limited only by the claims hereinbelow.

What is claimed is:

1. A selvedge trimmer for weaving looms of the type including a short sword system comprising the rocker shaft that drives the lay assembly is very close to the lay resulting in a relatively short pivot radius between the axis of rotation of the rocker shaft and the lay, said selvedge trimming mechanism is operated responlsive to reciprocal arcuate movement of the lay, said selvedge trimming mechanism comprising:

(a) a stationarily mounted cutting apparatus comprising a fixed blade and a movable blade mounted on a cutter support shaft comprising a fixed pivot point for rotation of said blade into operative engagement with said fixed blade; and (b) linkage means consisting of said fixed pivot point and a plurality of movable pivots (P1 and 29) connecting said lay and said cutter support shaft for rotating said cutter support shaft responsive to the reciprocal arcuate movement of said lay assembly.

2. The selvedge trimming mechanism according to claim 1 wherein said linkage means includes a stroke length reduction means therein.

3. The selvedge trimming mechanism according to claim 2 wherein said linkage means is a "four bar linkage" and comprises:

(a) a first arm secured at one end thereof to said lay, depending downwardly and forwardly therefrom and terminating in a lower end, the lower end of said first arm having imparted thereto a downward and forward arcuate movement responsive to the arcuate movement of said rocker shaft from its rearward to its forward position;

(b) a second reciprocal arm having the rear end thereof pivotally attached to the lower end of said first arm and establishing therewith a first floating pivot point, said second arm extending generally horizontally and forwardly from said first pivot point to terminate at the forward end thereof, the forward end of said second arm having imparted thereto a forward, but reduced in length, stroke responsive to arcuate movement of said rocker shaft from its rearward to its forward position;

(c) a third rocker arm having the lower end thereof pivotally attached to the forward end of said second arm at a second floating pivot point, said third arm extending generally upwardly from said pivot point to terminate at the upper end thereof, said third arm having imparted thereto a reciprocating arcuate movement responsive to the arcuate movement of said rocker shaft from its rearward to its forward position;

(d) the upper end of said third arm secured to said cutter support shaft in operative relation thereto, whereby said linkage means transfers the abrupt arcuate movement of said rocker shaft to a smooth pivotal movement of said movable blade after effecting a reduction of the stroke length by said linkage means.

4. The selvedge trimming mechanism according to claim 3 wherein said third arm includes an offset in the length thereof for the purpose of avoiding any air control cam shaft positioned immediately below the cutting apparatus.

* * * * *